US010029488B2

(12) United States Patent
Murotani et al.

(10) Patent No.: US 10,029,488 B2
(45) Date of Patent: Jul. 24, 2018

(54) PRINTING APPARATUS

(71) Applicant: Seiko Epson Corporation, Tokyo (JP)

(72) Inventors: Tomoya Murotani, Shiojiri (JP); Kenichi Miyazaki, Shiojiri (JP); Naotoshi Yanagidaira, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/358,247

(22) Filed: Nov. 22, 2016

(65) Prior Publication Data

US 2017/0151814 A1 Jun. 1, 2017

(30) Foreign Application Priority Data

Nov. 30, 2015 (JP) ..... 2015-232817

(51) Int. Cl.
*B41J 2/01* (2006.01)
*B41J 11/04* (2006.01)
*B41J 13/02* (2006.01)

(52) U.S. Cl.
CPC ..... *B41J 11/04* (2013.01); *B41J 2/01* (2013.01); *B41J 13/025* (2013.01)

(58) Field of Classification Search
CPC ..... B41J 2/01; B41J 13/025; B41J 11/04
See application file for complete search history.

(56) References Cited

U.S. PATENT DOCUMENTS

2003/0048968 A1 3/2003 Korting et al.
2011/0221844 A1* 9/2011 Todoriki ..... B41J 13/02 347/104
2014/0285603 A1* 9/2014 Kato ..... B41J 13/025 347/104

FOREIGN PATENT DOCUMENTS

JP 05-208773 A 8/1993
JP 2000-056530 A 2/2000
JP 2003-534511 A 11/2003
JP 2005-112509 4/2005

* cited by examiner

*Primary Examiner* — Lamson Nguyen
(74) *Attorney, Agent, or Firm* — Workman Nydegger

(57) ABSTRACT

A printing apparatus includes a transport drive roller that transports a medium, a roller support unit that supports the transport drive roller on one side in a first direction, a base member that supports the roller support unit on the one side in the first direction, and a first fulcrum portion via which the roller support unit and the base member are made to contact each other. The roller support unit is configured so as to pivot upon the first fulcrum portion about an axis oriented in the first direction.

10 Claims, 12 Drawing Sheets

PRINTING APPARATUS

BACKGROUND

1. Technical Field

The present invention relates to a printing apparatus.

2. Related Art

Printing apparatuses thus far known include an ink jet printer that ejects a liquid onto a medium thereby recording images and characters on the medium. The ink jet printer is configured to alternately repeat the ejection of the liquid onto the medium and transport of the medium in a transport direction. Such a printing apparatus includes a transport unit for transporting the medium. The transport unit includes a plurality of rollers, and hence some measures have been taken to improve contact efficiency between the roller and the medium. For example, JP-A-5-208773 discloses a discharging transport device applicable to an image forming apparatus (printing apparatus) that includes a discharge roller and a roller holder unit disposed in contact with the discharge roller and swingably supported.

However, the roller support unit (roller holder unit) according to JP-A-5-208773 can only swing about an axis parallel to the axial direction of the transport roller (discharge roller), and therefore the inclination of the roller support unit with respect to the transport roller is unable to be adjusted to a desired extent. When the roller support unit is made to contact the transport roller in an inclined posture, a load generated between the transport roller and the roller support unit locally concentrates at a specific point. Therefore, the transport roller and the roller support unit may locally wear, thereby degrading the durability of the transport roller and the roller support unit.

SUMMARY

Accordingly, the present invention may be advantageously realized as the following application examples and embodiments.

Application Example 1

A first application example represents a printing apparatus including a transport roller that transports a medium, a roller support unit that supports the transport roller on one side in a first direction, a base member that supports the roller support unit on the one side in the first direction, and a first fulcrum portion via which the roller support unit and the base member are made to contact each other. The roller support unit is configured so as to pivot upon the first fulcrum portion about an axis oriented in the first direction.

In this application example, the roller support unit is configured so as to pivot upon the first fulcrum portion about the axis oriented in the first direction. Accordingly, the inclination of the roller support unit with respect to the transport roller is corrected, and therefore local wear of the transport roller and the roller support unit can be prevented, which leads to improved durability of the transport roller and the roller support unit.

Application Example 2

In the printing apparatus according to the first application example, preferably, the first fulcrum portion may be provided on the roller support unit, and a region of the first fulcrum portion to contact the base member may be formed in a spherical shape.

In this application example, the roller support unit includes the first fulcrum portion, a region of which to contact the base member is formed in a spherical shape. Such a configuration facilitates the roller support unit to pivot upon the first fulcrum portion about the axis oriented in the first direction.

Application Example 3

In the printing apparatus according to the foregoing application examples, preferably, the first fulcrum portion may be provided on the base member, and a region of the first fulcrum portion to contact the roller support unit may be formed in a spherical shape.

In this application example, the base member includes the first fulcrum portion, a region of which to contact the roller support unit is formed in a spherical shape. Such a configuration facilitates the roller support unit to pivot upon the first fulcrum portion about the axis oriented in the first direction.

Application Example 4

In the printing apparatus according to the foregoing application examples, preferably, the roller support unit may include a second fulcrum portion that contacts the base member at a different position from the first fulcrum portion, so as to pivot upon the second fulcrum portion about an axis oriented in a second direction intersecting the first direction.

In this application example, the roller support unit can pivot upon the second fulcrum portion about the axis oriented in the second direction. Such a configuration enables the inclination of the roller support unit with respect to the transport roller to be corrected, to thereby prevent local wear of the transport roller and the roller support unit, thus improving the durability of the transport roller and the roller support unit.

Application Example 5

In the printing apparatus according to the foregoing application examples, preferably, the second fulcrum portion may be formed such that a cross-section of a region to contact the base member has an arcuate shape when viewed in the second direction.

In this application example, the roller support unit includes the second fulcrum portion, formed such that the cross-section of the region to contact the base member has an arcuate shape when viewed in the second direction. Such a configuration facilitates the roller support unit to pivot upon the second fulcrum portion about the axis oriented in the second direction.

Application Example 6

In the printing apparatus according to the foregoing application examples, preferably, the roller support unit may include a rotatable bearing unit and a bearing retainer unit that supports the bearing unit, and the transport roller may be supported by the bearing unit.

In this application example, the roller support unit supports the transport roller via the bearing unit. Therefore, the wear of the roller support unit and the transport roller can be minimized.

Application Example 7

In the printing apparatus according to the foregoing application examples, preferably, the bearing unit may include a first bearing and a second bearing that support the transport roller at different positions, and the roller support unit may be caused to pivot when the first bearing and the second bearing are made to contact the transport roller.

In this application example, the roller support unit includes a plurality of bearings, namely the first and second bearings, which support the transport roller. Therefore, the load of the transport roller can be distributed to each of the bearings. In addition, the inclination of the roller support unit can be corrected, when the roller support unit is made to pivot upon the first fulcrum portion and the second fulcrum portion by the contact realized between the first and second bearings and the transport roller. Therefore, local wear of the transport roller and the first and second bearings can be prevented.

Application Example 8

In the printing apparatus according to the foregoing application examples, preferably, the bearing unit may be inserted in an insertion direction coinciding with a direction in which the bearing unit is subjected to force from the transport roller, so as to be supported by the bearing retainer unit.

In this application example, bearing unit is inserted in the bearing retainer unit in the insertion direction coinciding with the direction in which the bearing unit is subjected to the force from the transport roller. Such a configuration allows the transport roller to be stably supported.

Application Example 9

In the printing apparatus according to the foregoing application examples, preferably, the bearing unit may include the first bearing and the second bearing that support the transport roller at different positions, the bearing retainer unit may include a first bearing retainer and a second bearing retainer in each of which the bearing is inserted, and the first bearing may be inserted in a first insertion direction to be supported by the first bearing retainer, and the second bearing may be inserted in a second insertion direction different from the first insertion direction, to be supported by the second bearing retainer.

In this application example, the first and second bearings, supporting the transport roller at different positions, are respectively inserted in the bearing retainer unit in the first and second insertion directions, coinciding with the directions in which the bearings are subjected to the force from the transport roller. Such a configuration allows the transport roller to be stably supported.

Application Example 10

In the printing apparatus according to the foregoing application examples, preferably, the bearing unit may include the first bearing and the second bearing that support the transport roller at different positions, and the first bearing and the second bearing may be deviated from each other in the first direction.

In this application example, the first bearing and the second bearing are deviated from each other in the first direction, and therefore, even when force is exerted only on one side of the transport roller in the second direction, the positions of the first bearing and the second bearing can be varied in the first direction according to the direction in which the force is exerted, so that the transport roller can be supported with unchanged stability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
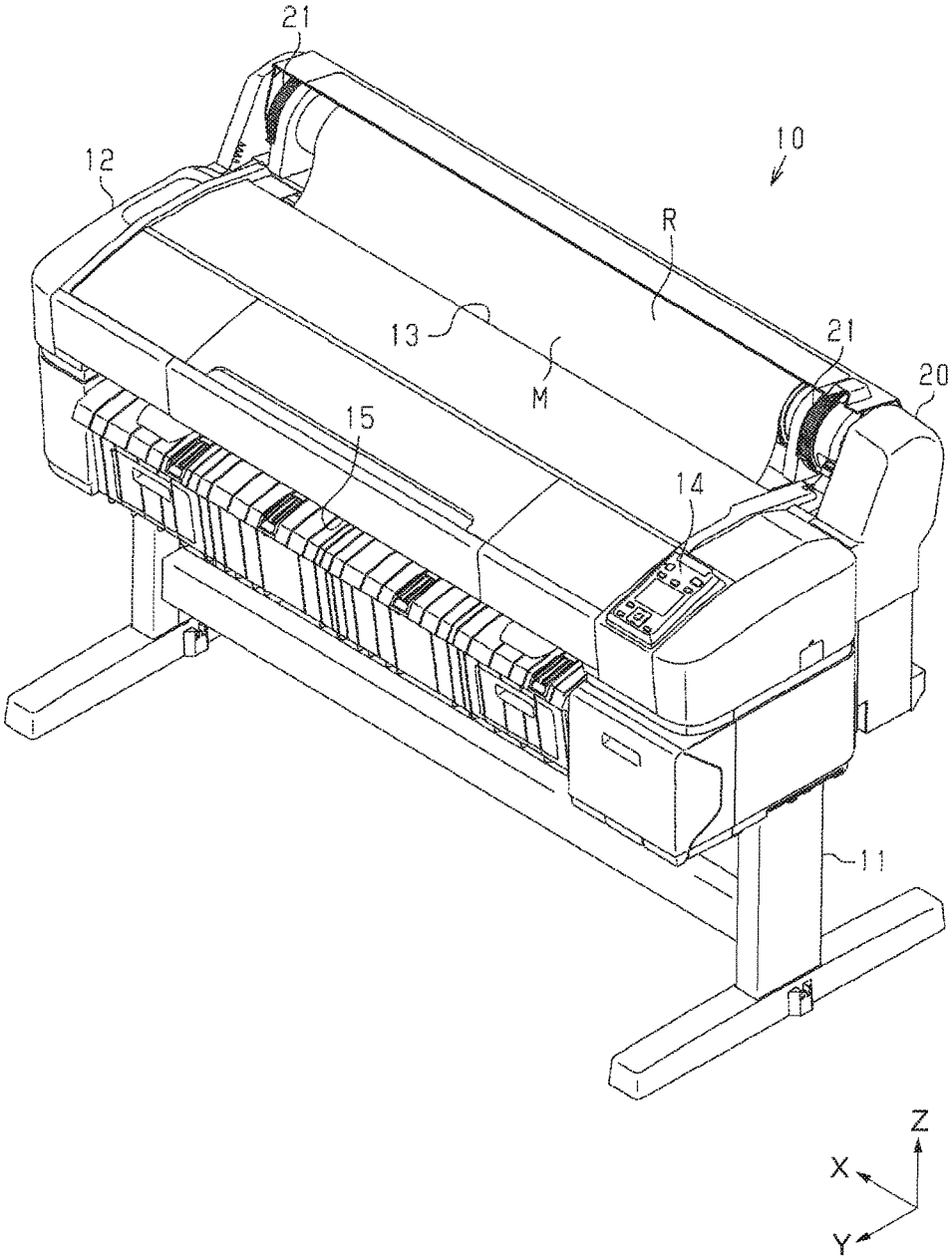
FIG. 1 is a perspective view showing a general configuration of a printing apparatus according to an embodiment.

Referring to the drawings, an embodiment of the present invention will be described hereunder. In the drawings referred to hereunder, components are illustrated in different scale reduction, to visibly exhibit the components on the drawing.

For the purpose of description, an X-axis, a Y-axis, and a Z-axis representing three axes orthogonal to each other are indicated in each drawing, and the leading end side of each arrow indicating the direction will be defined as "+ side", and the base side of each arrow will be defined as "− side". A direction parallel to the X-axis will be referred to as "X-axis direction", a direction parallel to the Y-axis will be referred to as "Y-axis direction", and a direction parallel to the Z-axis will be referred to as "Z-axis direction".

Embodiment

General Configuration of Printing Apparatus

FIG. 1 is a perspective view showing a general configuration of a printing apparatus according to an embodiment. First, the general configuration of the printing apparatus 10 will be described with reference to FIG. 1. The printing apparatus 10 according to this embodiment is an ink jet printer that ejects liquid droplets from an ejecting head onto a medium, thereby recording an image on the medium.

As shown in FIG. 1, the printing apparatus 10 includes a generally rectangular block-shaped casing 12 supported by a pair of legs 11, and a feed unit 20 that feeds the medium M to the casing 12. In this embodiment, an up-down direction parallel to the gravity direction will be defined as Z-axis, and a +Z-axis direction will represent an upward direction. The longitudinal direction of the casing 12 and the width direction of the medium M, intersecting the Z-axis, will be defined as X-axis, and a +X-axis direction will represent a direction toward the left. The direction in which the medium M is transported in the casing 12, intersecting both the Z-axis and the X-axis will be defined as Y-axis, and a +Y-axis direction will represent a forward direction.

The feed unit 20 is mounted so as to protrude upward (to the +Z-axis side) from a rear side (−Y-axis side) of the casing 12, and configured to accommodate therein a roll R formed by winding the medium M in a cylindrical shape. The feed unit 20 includes a pair of roll retainers 21 located at the respective end portions of the roll R in the axial direction, so as to rotatably support the roll R. When the roll R is driven to rotate by a non-illustrated roll drive motor, the medium M is unwound from the roll R and introduced into the casing 12.

An inlet 13, through which the medium M unwound from the roll R placed in the feed unit 20 is introduced into the casing 12, is opened at an upper position of the rear face of the casing 12. In addition, an operation panel 14 is provided on the upper face of the casing 12, at an end portion thereof in the longitudinal direction (on the right in FIG. 1), so that a user can input various settings of the printing apparatus 10 and printing instructions. Further, an outlet 15, through which the medium M introduced into the casing 12 through the inlet 13 is discharged to outside, is opened in the front face of the casing 12.

Figure 2:
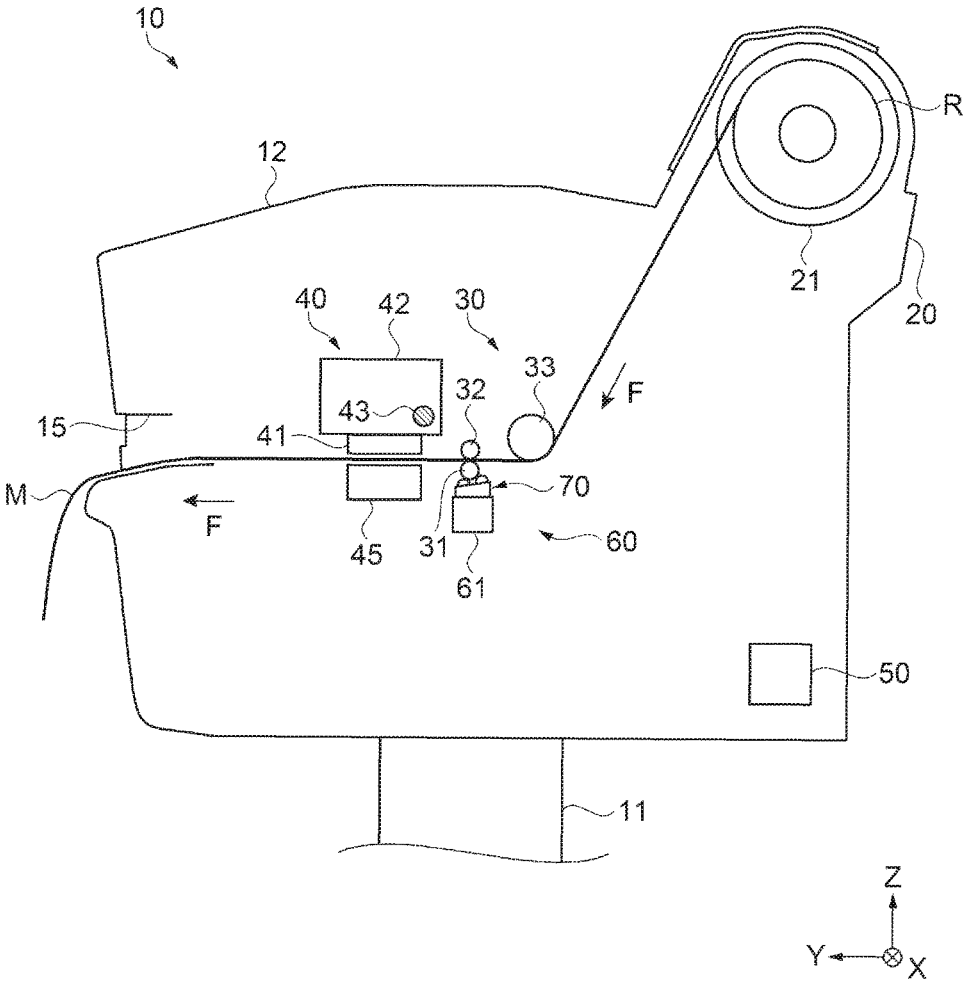
FIG. 2 is a schematic cross-sectional view showing a configuration inside a casing.

FIG. 2 is a schematic cross-sectional view showing a configuration inside the casing. As shown in FIG. 2, the printing apparatus 10 includes, inside the casing 12, a transport unit 30 that transports the medium M in a transport direction F, a printing unit 40 that prints images on the medium M, and so forth, and also a control unit 50 that controls the operation of the cited units.

The transport unit 30 includes a transport drive roller 31, which serves as transport roller that transports the medium M. To be more detailed, the transport unit 30 includes the transport drive roller 31, a transport slave roller 32, and a transport guide roller 33 located upstream of the printing unit 40 in the transport direction F of the medium M, and having a longer axial length than the width of the medium M. The transport guide roller 33 guides the medium M delivered from the feed unit 20 on the casing 12 toward the printing unit 40. The transport slave roller 32 is pressed against the transport drive roller 31 via the medium M, so as to follow up the rotation of the transport drive roller 31. The transport drive roller 31 holds the medium M in collaboration with the transport slave roller 32, so that when the transport drive roller 31 is driven to rotate by a non-illustrated roller drive motor, the medium M is transported in the transport direction F. The transport unit 30 also includes a plurality of roller support assemblies 60. The roller support assemblies 60 are aligned in the width direction of the medium M (X-axis direction), to support the transport drive roller 31.

The printing unit 40 includes a recording head 41 that ejects ink onto the medium M, a carriage 42 on which the recording head 41 is mounted, and a platen 45 for supporting the medium M. The recording head 41 includes a plurality of non-illustrated nozzles through which the ink is ejected. The carriage 42 supporting the recording head 41 is driven so as to reciprocate in the width direction of the medium M (X-axis direction), by a non-illustrated carriage drive motor. The platen 45 includes a generally rectangular surface on the upper face thereof opposing the recording head 41, having the longitudinal sides oriented in the width direction of the medium M (X-axis direction). The medium M is adsorbed to the upper face of the platen 45 thus to be supported, by a negative pressure applied to the platen 45. Therefore, degradation in recording quality due to floating of the medium M can be prevented.

Through alternate repetitions of ejection of the ink from the recording head 41 onto the medium M performed by the printing unit 40 while the carriage 42 is reciprocating in the X-axis direction, and the transport of the medium M in the transport direction F performed by the transport unit 30, images and characters are printed on the medium M. Here, although in this embodiment the recording head 41 is exemplified by a serial head mounted on the carriage that reciprocates so as to eject the ink while being made to reciprocate in the width direction of the medium M (±X-axis direction), a line head aligned and fixed so as to extend in the width direction of the medium M (X-axis direction) may be employed.

Roller Support Unit

Figure 3:
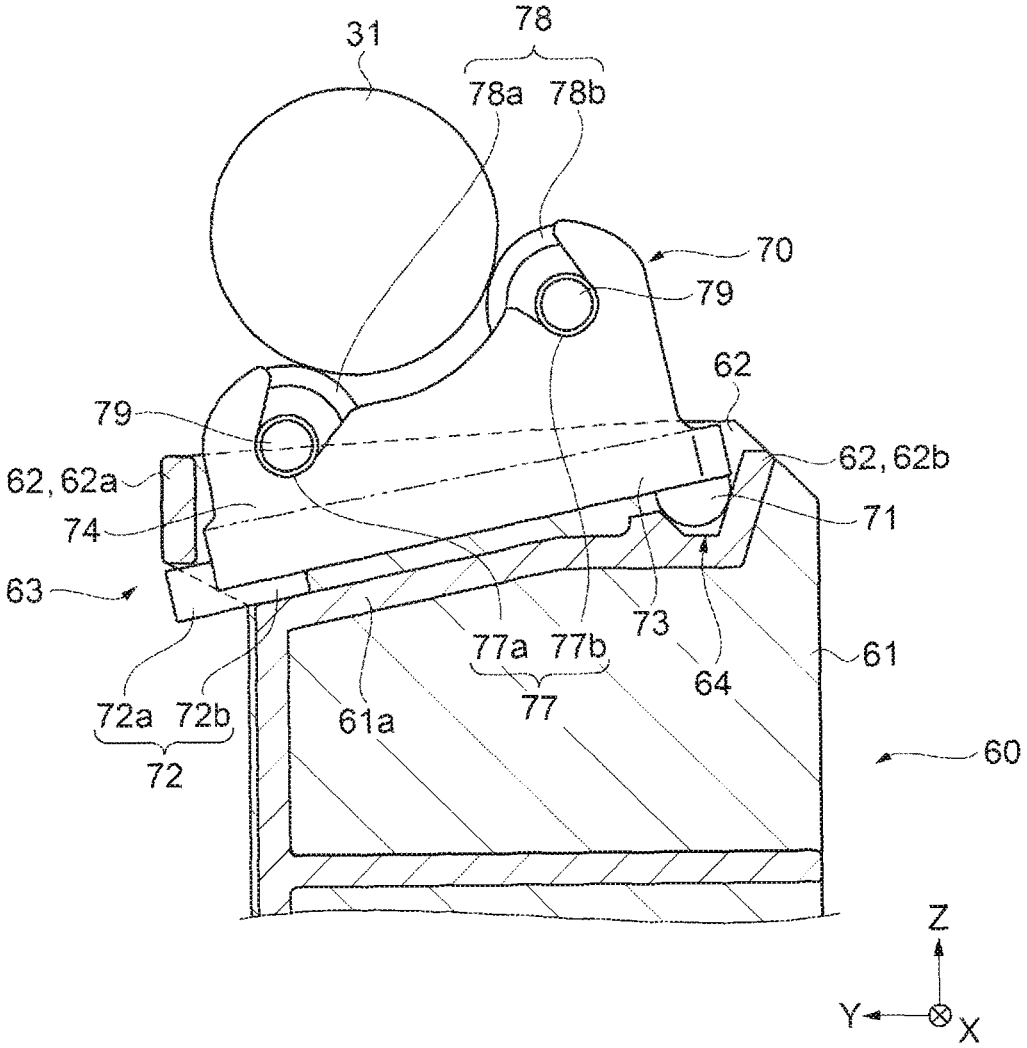
FIG. 3 is a side view showing a roller support assembly.
Figure 4:
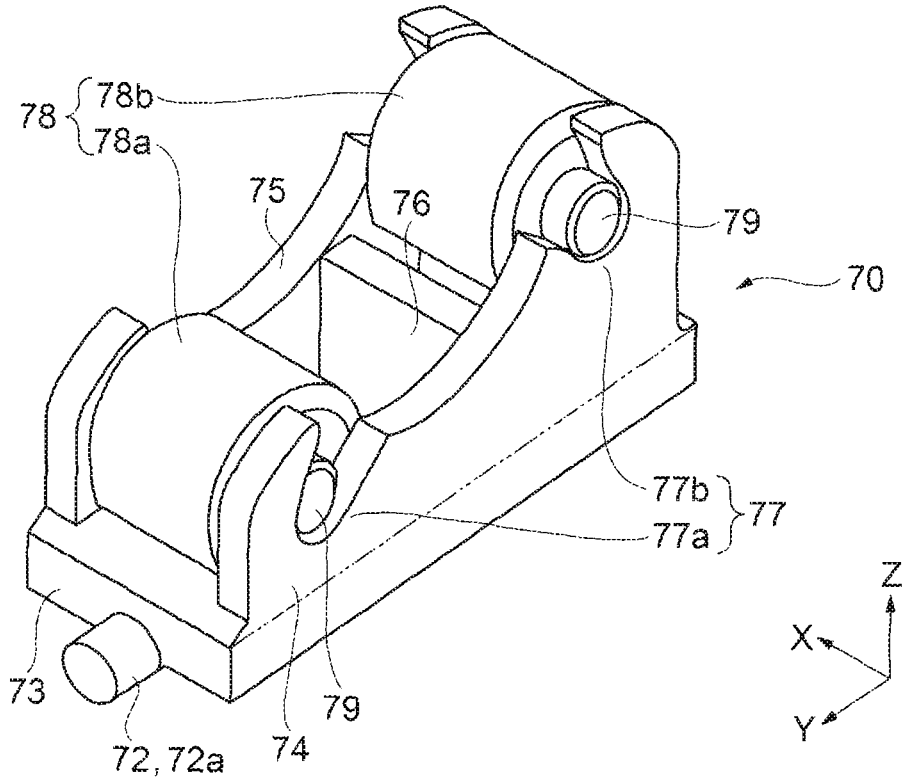
FIG. 4 is a perspective view showing a configuration of a roller support unit.
Figure 5:
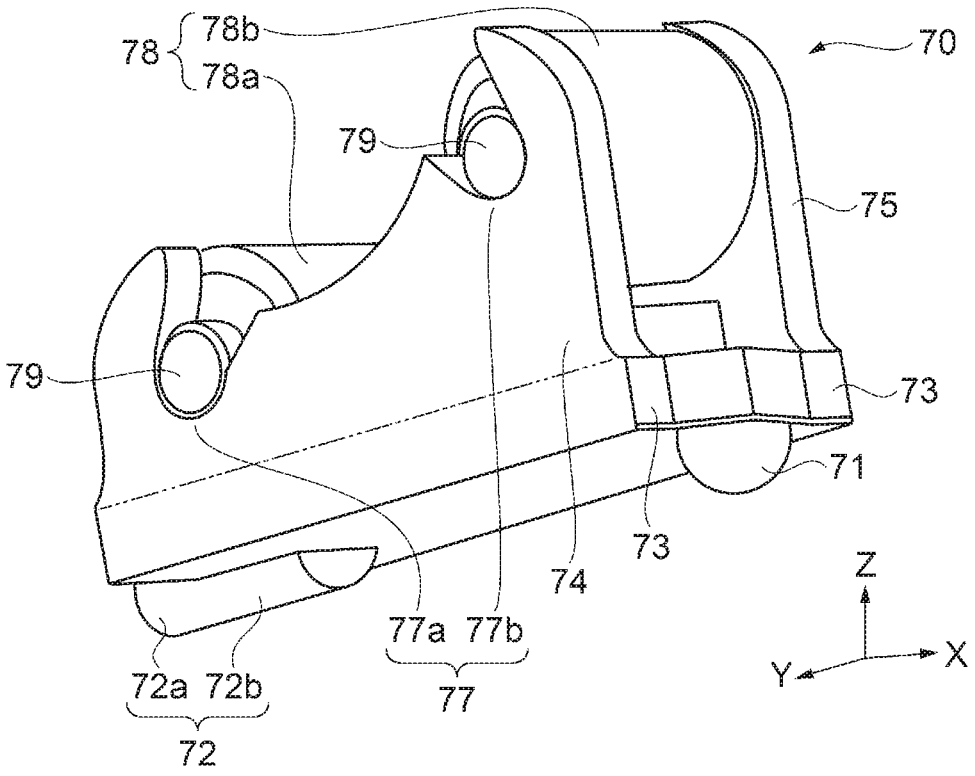
FIG. 5 is a perspective view showing the configuration of the roller support unit, from below.

FIG. 3 is a side view showing the roller support assembly. FIG. 4 and FIG. 5 are perspective views each showing a configuration of the roller support unit. In FIG. 3, a base portion is illustrated as a cross-sectional view.

Referring to FIG. 3 to FIG. 5, the configuration of the roller support unit 70 will be described hereunder.

The roller support assembly 60 includes a base portion 61 and a roller support unit 70. The roller support unit 70 supports the transport drive roller 31 at a lower side thereof in the Z-axis direction (−Z-axis side), corresponding to the one side in the first direction in the present invention. The base portion 61 supports the roller support unit 70 on the −Z-axis side in the Z-axis direction.

The base portion 61 has a generally rectangular block shape, with the longer sides oriented along the transport direction F of the medium M (Y-axis direction). An upper face 61*a* (+Z-axis side) supporting the roller support unit 70 is moderately inclined downward (to the −Z-axis side) toward a downstream side in the transport direction F. An outer wall 62 is formed on the upper face 61*a* of the base portion 61, so as to surround the outer periphery of the roller support unit 70 in a bath tub-like shape. An outer wall 62*a* on the +Y-axis side (downstream side) protrudes in the +Y-axis direction, and an opening 63 is formed between the lower end of the outer wall 62 and the upper face 61*a*, so as to be engaged with a protruding portion 72*a* of a second fulcrum portion 72, which will be subsequently described. In addition, the upper face 61*a* of the base portion 61 includes a groove 64 having a V-shaped cross-section in a view in the width direction of the medium M (X-axis direction), formed along an outer wall 62*b* on the −Y-axis side (upstream side), the outer wall 62*b* being inclined along the V-shape of the groove 64. Here, a margin is provided in the outer wall 62 surrounding the outer periphery of the roller support unit 70, so as to allow the roller support unit 70 to pivot about an axis oriented in the Z-axis direction or an axis oriented in the Y-axis direction, respectively corresponding to the first direction and the second direction in the present invention.

The casing of the roller support unit 70 includes a rectangular base plate 73 having the longer sides oriented in the transport direction F of the medium, a sidewall 74 erected upward in the Z-axis direction from one of the longer sides of the base plate 73, a sidewall 75 erected upward in the Z-axis direction from the other longer side of the base plate 73, and a wall-shaped beam 76 connecting between the inner surface of the sidewall 74 and the inner surface of the sidewall 75 in the X-axis direction.

The roller support unit 70 also includes a bearing unit 78 configured to rotate along the transport direction F of the medium (Y-axis direction), and a bearing retainer unit 77 that supports the bearing unit 78, and the transport drive roller 31 is supported by the bearing unit 78. The bearing unit 78 is composed of an outer wheel, an inner wheel, and spherical rolling elements held between the outer wheel and the inner wheel. The bearing unit 78 according to this embodiment includes a shaft 79 located at the center of the inner wheel to fix the bearing unit 78, so that the outer wheel rotates with respect to the inner wheel fixed via the shaft 79. The bearing retainer unit 77 is provided in the sidewall 74 and the sidewall 75 of the roller support unit 70, so as to support the shafts 79 of the bearing unit 78 oriented parallel to each other in the X-axis direction. When the shafts 79 are inserted in the bearing retainer unit 77, the bearing unit 78 is supported by the roller support unit 70. Accordingly, the transport drive roller 31 is rotatably supported by the roller support unit 70 via the bearing unit 78, and therefore the wear of the roller support unit 70 and the transport drive roller 31 can be minimized.

The bearing unit 78 is supported by the bearing retainer unit 77 by being inserted therein in an insertion direction coinciding with a direction in which the bearing unit bearing unit 78 is subjected to the force from the transport drive roller 31. In this embodiment, the bearing unit 78 includes a first bearing 78*a* and a second bearing 78*b* that support the transport drive roller 31 at different positions. In other words, the bearing unit 78 includes the first bearing 78*a* and the second bearing 78*b* that supports the transport drive roller 31 at a different position from the first bearing 78*a*. In addition, the bearing retainer unit 77 includes a first bearing retainer 77*a* and a second bearing retainer 77*b* in which the bearing unit 78 can be inserted from different directions. The first bearing 78*a* and the second bearing 78*b* are provided along the transport direction F of the medium (Y-axis direction). The first bearing 78*a* and the second bearing 78*b* may each be composed of a plurality of bearings aligned in the axial direction of the shaft 79.

The first bearing 78*a* is inserted in the first bearing retainer 77*a* along a first insertion direction, thus to be supported thereby. To be more detailed, the first bearing retainer 77*a* is located in an upper portion (+Z-axis side) of the downstream side (+Y-axis side) of the sidewalls 74, 75, and the upper ends of the sidewalls 74, 75 on the downstream side protrude in an arcuate shape along the outer circumference of the first bearing 78*a*. In addition, the first bearing retainer 77*a* is formed as a U-shaped opening along the direction of a line connecting between the center of the arc of the sidewalls 74, 75 and the center of the transport drive roller 31, in other words the first insertion direction in which the first bearing 78*a* is subjected to the force from the transport drive roller 31. Thus, the first bearing 78*a* is inserted in the first bearing retainer 77*a* along the first insertion direction.

The second bearing 78*b* is inserted in the second bearing retainer 77*b* along a second insertion direction different from the first insertion direction, thus to be supported thereby. To be more detailed, the second bearing retainer 77*b* is located in an upper portion (+Z-axis side) of the upstream side (−Y-axis side) of the sidewalls 74, 75, and the upper ends of the sidewalls 74, 75 on the upstream side protrude in an arcuate shape along the outer circumference of the second bearing 78*b*. In addition, the second bearing retainer 77*b* is formed as a U-shaped opening along the direction of a line connecting between the center of the arc of the sidewalls 74, 75 and the center of the transport drive roller 31, in other words the second insertion direction in which the second bearing 78*b* is subjected to the force from the transport drive roller 31. Thus, the second bearing 78*b* is inserted in the second bearing retainer 77*b* along the second insertion direction, and therefore the transport drive roller 31 can be stably supported.

The transport drive roller 31 is supported by the first and second bearings 78*a*, 78*b* respectively inserted in the first and second bearing retainers 77*a*, 77*b* in the first and second insertion directions, coinciding with the directions in which the first and second bearings 78*a*, 78*b* are subjected to the force from the transport drive roller 31. With such a configuration, the roller support unit 70 can stably support the transport drive roller 31. Here, a portion of the upper end of each of the sidewalls 74, 75 between the first bearing retainer 77*a* and the second bearing retainer 77*b* is recessed in an arcuate shape along the outer circumference of the transport drive roller 31, so as to avoid interference between the transport drive roller 31 and the sidewalls 74, 75 when the transport drive roller 31 is supported by the first and second bearings 78*a*, 78*b*. Alternatively, the portion of the upper end of each of the sidewalls 74, 75 between the first bearing retainer 77*a* and the second bearing retainer 77*b* may be recessed in a cut-away shape.

The first bearing 78*a* and the second bearing 78*b* are deviated from each other in the Z-axis direction, corresponding to the first direction. More specifically, the second bearing 78*b* on the upstream side in the transport direction F is located at a higher position (+Z-axis side) than the first bearing 78*a* on the downstream side. In the printing apparatus 10 according to this embodiment, the medium M is transported in the transport direction F with a tension acting thereon toward the upstream side (−Y-axis side) in the transport direction F, to prevent the medium M from being slackened. Although the transport drive roller 31 is subjected to, in addition to the force in the gravity direction (−Z-axis side) originating from the self-weight, the tension acting toward the −Y-axis side, such forces can be evenly distributed to the first and second bearings 78*a*, 78*b*, since the second bearing 78*b* is located at a higher position than the first bearing 78*a*. Therefore, the roller support unit 70 can stably support the transport drive roller 31.

The roller support assembly 60 includes a first fulcrum portion 71, via which the roller support unit 70 and the base portion 61 are made to contact each other. In this embodiment, the first fulcrum portion 71 is provided on the roller support unit 70. The first fulcrum portion 71 is formed on the bisector equally dividing the shorter side of the base plate 73, so as to protrude downward (−Z-axis side) from the lower surface (surface on the −Z-axis side) of the base plate 73 at the upstream end thereof (−Y-axis side) in the transport direction F. The portion of the first fulcrum portion 71 to contact the base portion 61 is formed in a spherical shape. More specifically, the first fulcrum portion 71 protrudes in a hemispherical shape from the lower surface of the base plate 73. The shorter side of the base plate 73 on the upstream side is formed so as to protrude from the both end portions to a point on the bisector, so as to overlap the first fulcrum portion 71 of the hemispherical shape, in a plan view.

The roller support unit 70 includes a second fulcrum portion 72 disposed to contact the base portion 61 at a different position from the first fulcrum portion 71. A portion of the second fulcrum portion 72 to contact the base portion 61 is formed so as to have an arcuate cross-section, when viewed in the Y-axis direction corresponding to the second direction. To be more detailed, the second fulcrum portion 72 is formed on the bisector equally dividing the shorter side of the base plate 73, and includes a protruding portion 72*a* formed so as to protrude to the downstream side in the transport direction F from the downstream end (+Y-axis side) of the base plate 73, and an extending portion 72*b* formed so as to extend to the upstream side from the end portion of the base plate 73 on the +Y-axis side, along the lower surface (surface on the −Z-axis side) of the base plate 73. The upstream end portion of the extending portion 72*b* of the second fulcrum portion 72 is disposed to contact the upper face 61*a* of the base portion 61.

The extending portion 72*b* of the second fulcrum portion 72 has a semicircular column shape, formed by dividing a circular column in two pieces from the upper face to the lower face, and protrudes downward (−Z-axis direction) in a semicircular arcuate shape when viewed in the Y-axis direction. The protruding portion 72*a* of the second fulcrum portion 72 has a circular column shape continuously extending from the semicircular column shape of the extending portion 72*b*. Alternatively, the circular column shape may be substituted with an elliptical column shape.

When the protruding portion 72*a* of the second fulcrum portion 72 is inserted in the opening 63 of the base portion 61, the perimeter of the base plate 73 is located inside the region defined by the outer wall 62 of the base portion 61, so that the roller support unit 70 is set on the upper face 61*a* of the base portion 61. At this point, the first fulcrum portion 71 enters into contact with the groove 64 of the base portion 61, and the upstream end portion of the extending portion 72*b* of the second fulcrum portion 72 enters into contact with the upper face 61*a* of the base portion 61.

Figure 6:
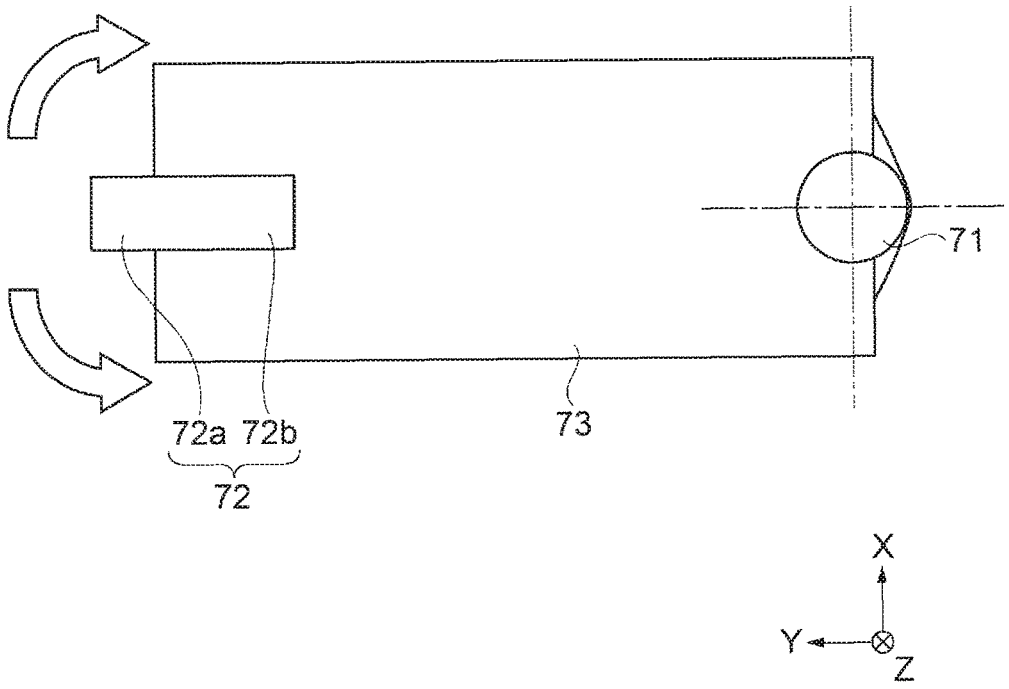
FIG. 6 is a bottom view of the roller support unit.
Figure 7:
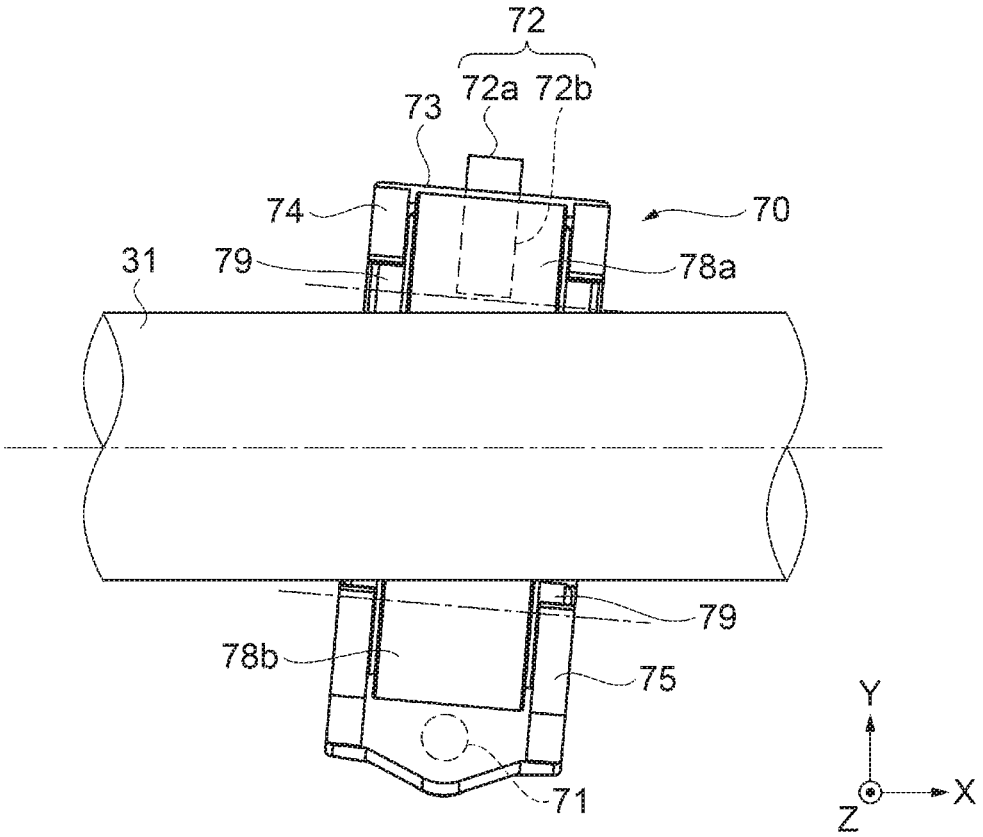
FIG. 7 is a plan view showing a positional relationship between the roller support unit and a transport drive roller, the roller support unit being in an inclined posture.
Figure 8:
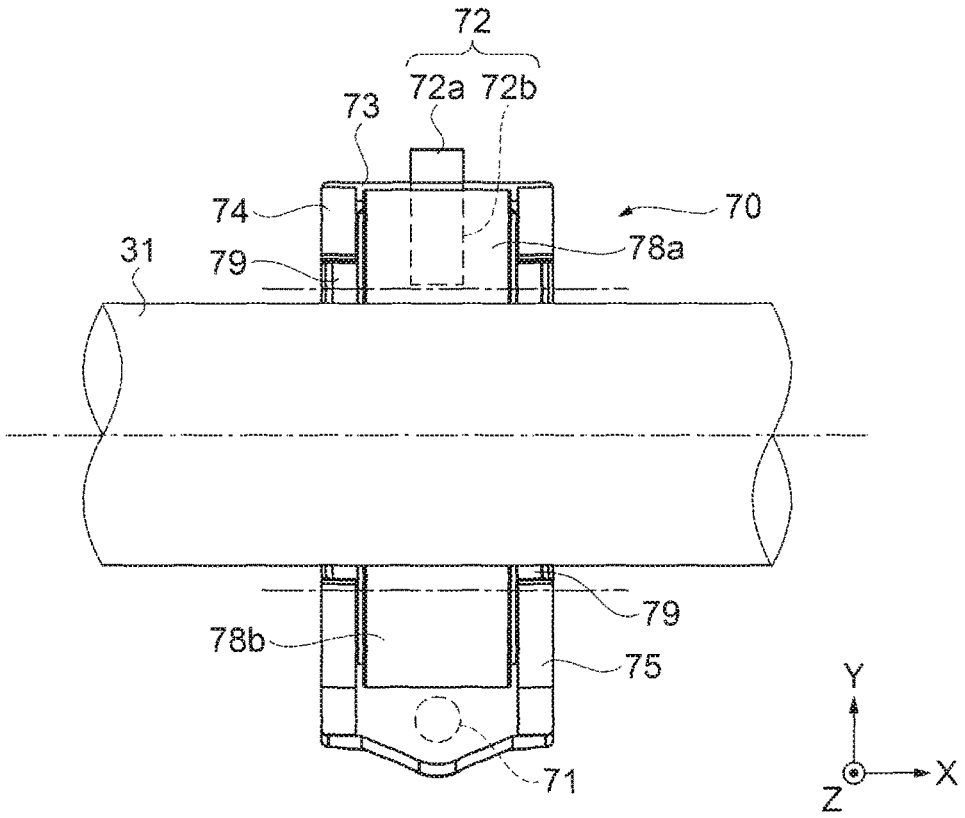
FIG. 8 is a plan view showing a positional relationship between the roller support unit and the transport drive roller, the roller support unit being in a corrected posture.

FIG. 6 is a bottom view of the roller support unit. FIG. 7 is a plan view showing a positional relationship between the roller support unit and the transport drive roller, the roller support unit being in an inclined posture. FIG. 8 is a plan view showing a positional relationship between the roller support unit and the transport drive roller, the roller support unit being in a corrected posture. Referring to FIG. 6 to FIG. 8, the pivoting motion of the roller support unit 70 upon the first fulcrum portion 71 will be described hereunder.

The roller support unit 70 is configured to pivot upon the first fulcrum portion 71 about an axis oriented in the Z-axis direction corresponding to the first direction. To be more detailed, the first fulcrum portion 71 of the hemispherical shape is located in contact with the V-shaped groove 64 (see FIG. 3). Accordingly, as shown in FIG. 6, the roller support unit 70 can pivot upon the first fulcrum portion 71 about the axis oriented in the Z-axis direction. Because of the spherical shape of the first fulcrum portion 71, the roller support unit 70 can smoothly pivot upon the first fulcrum portion 71 about the axis oriented in the Z-axis direction. In FIG. 6, the pivoting directions (about the axis oriented in the Z-axis direction) of the roller support unit 70 are indicated by blank arrows.

The roller support assembly 60 may become inclined with respect to the transport drive roller 31 upon being mounted, depending on the assembly accuracy of the apparatus. As shown in FIG. 7 for example, the axial direction of the respective shafts 79 of the first and second bearings 78*a*, 78*b* of the roller support unit 70 may be inclined with respect to the transport drive roller 31 oriented parallel to the X-axis, in a plan view in the Z-axis direction. When the transport drive roller 31 is rotated under such a condition, the load generated between the transport drive roller 31 and the first and second bearings 78*a*, 78*b* concentrates at one end portion of each of the first and second bearings 78*a*, 78*b*, which may lead to local wear of the transport drive roller 31, as well as the first and second bearings 78*a*, 78*b*. In the roller support unit 70 according to this embodiment, however, the first bearing 78*a* and the second bearing 78*b* are made to pivot upon the first fulcrum portion 71 about the axis oriented in the Z-axis direction, because of being located in contact with the transport drive roller 31. Therefore, as shown in FIG. 8, the respective axial directions of the first and second bearings 78*a*, 78*b* are corrected so as to become parallel to the axial direction of the transport drive roller 31, and thus the local wear of the transport drive roller 31 and the first and second bearings 78*a*, 78*b* can be minimized.

Figure 9:
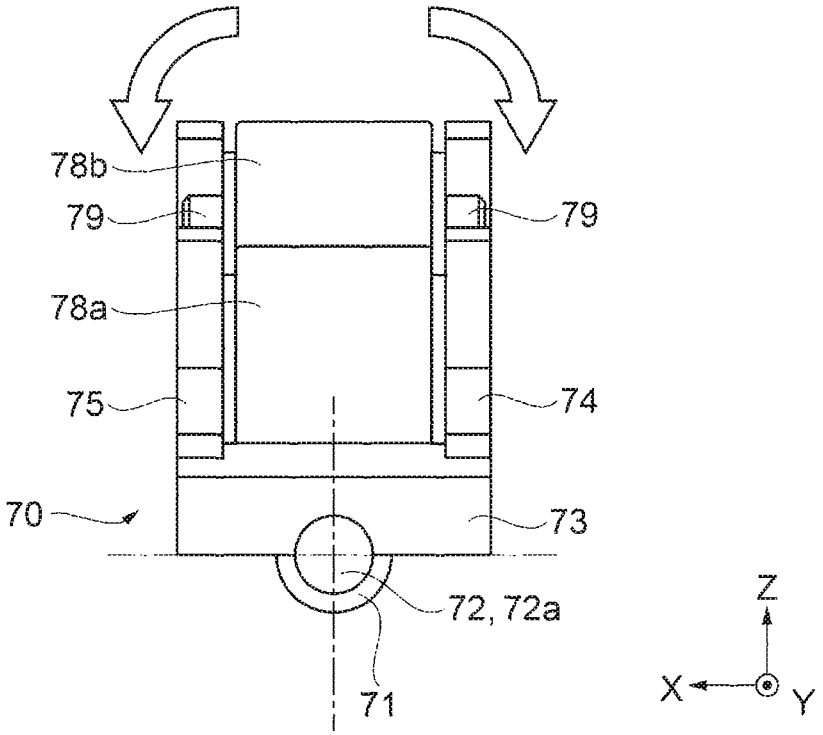
FIG. 9 is a front view of the roller support unit.
Figure 10:
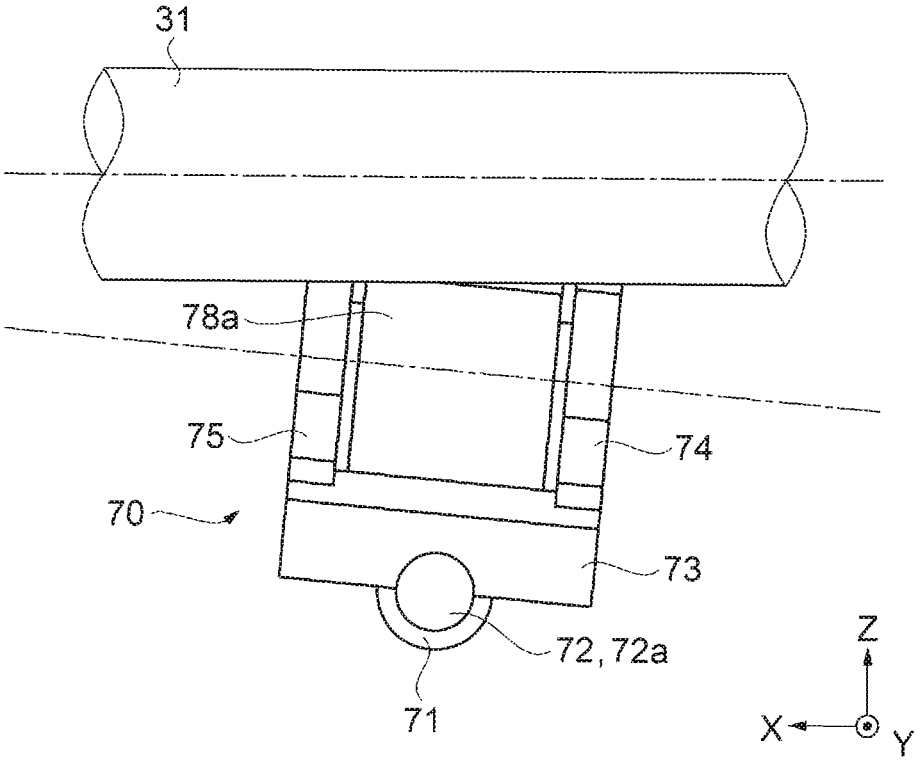
FIG. 10 is a front view showing a positional relationship between the roller support unit and the transport drive roller, the roller support unit being in an inclined posture.
Figure 11:
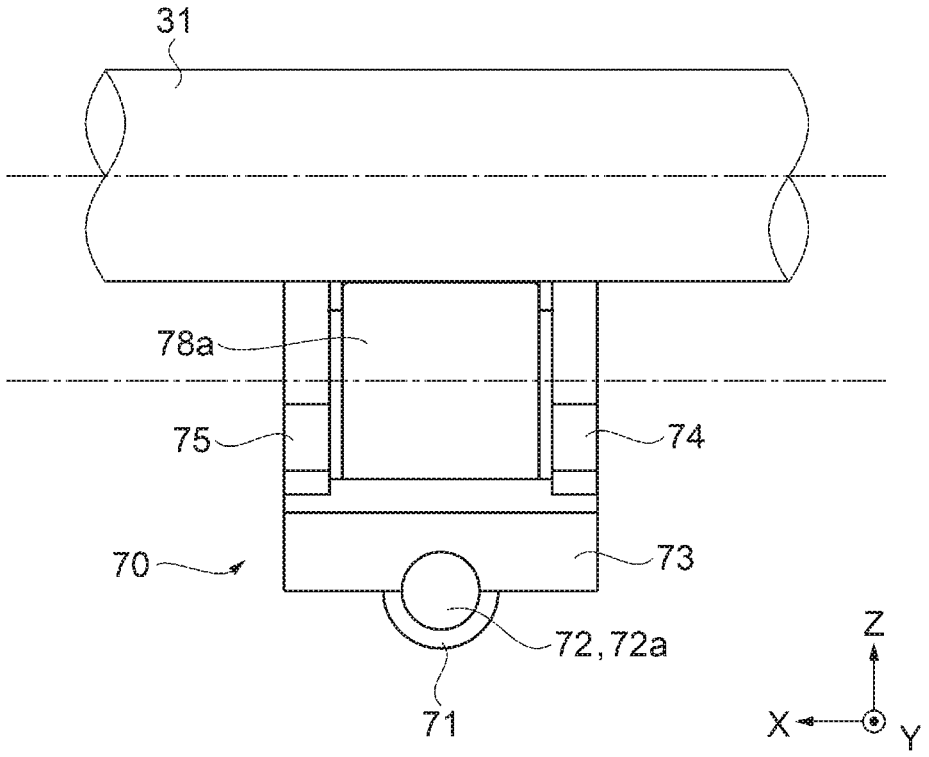
FIG. 11 is a front view showing a positional relationship between the roller support unit and the transport drive roller, the roller support unit being in the corrected posture.

FIG. 9 is a front view of the roller support unit. FIG. 10 is a front view showing a positional relationship between the roller support unit and the transport drive roller, the roller support unit being in an inclined posture. FIG. 11 is a front view showing a positional relationship between the roller support unit and the transport drive roller, the roller support unit being in the corrected posture. Referring to FIG. 9 to FIG. 11, the pivoting motion of the roller support unit 70 upon the second fulcrum portion 72 will be described hereunder.

The roller support unit 70 is configured to pivot upon the second fulcrum portion 72 about an axis oriented in the Y-axis direction corresponding to the second direction. To be more detailed, the second fulcrum portion 72 formed in the arcuate shape is located in contact with the upper face 61*a* of the base portion 61 (see FIG. 3). Accordingly, as shown in FIG. 9, the roller support unit 70 can pivot upon the second fulcrum portion 72 about the axis oriented in the Y-axis direction. Because of the spherical shape of the second fulcrum portion 72, the roller support unit 70 can smoothly pivot upon the second fulcrum portion 72 about the axis oriented in the Y-axis direction. In FIG. 9, the pivoting directions (about the axis oriented in the Y-axis direction) of the roller support unit 70 are indicated by blank arrows.

The roller support assembly 60 may become inclined with respect to the transport drive roller 31 upon being mounted, depending on the assembly accuracy of the apparatus. As shown in FIG. 10 for example, the axial direction of the respective shafts 79 of the first and second bearings 78*a*, 78*b* of the roller support unit 70 may be inclined with respect to the transport drive roller 31 oriented parallel to the X-axis, in a side view from the +Y-axis side. When the transport drive roller 31 is rotated under such a condition, the load generated between the transport drive roller 31 and the first and second bearings 78*a*, 78*b* concentrates at one end portion of each of the first and second bearings 78*a*, 78*b*, which may lead to local wear of the transport drive roller 31, as well as the first and second bearings 78*a*, 78*b*. In the roller support unit 70 according to this embodiment, however, the first bearing 78*a* and the second bearing 78*b* are made to pivot upon the second fulcrum portion 72 about the axis oriented in the Y-axis direction, because of being located in contact with the transport drive roller 31. Therefore, as shown in FIG. 11, the respective axial directions of the first and second bearings 78*a*, 78*b* are corrected so as to become parallel to the axial direction of the transport drive roller 31, and thus the local wear of the transport drive roller 31 and the first and second bearings 78*a*, 78*b* can be prevented.

As described above, the printing apparatus 10 according to this embodiment provides the following advantageous effects.

The printing apparatus 10 includes the roller support assembly 60 composed of the base portion 61 and the roller support unit 70. The roller support unit 70 includes the bearing unit 78 (first and second bearings 78*a*, 78*b*) that supports the transport drive roller 31 and the first and second bearing retainers 77*a*, 77*b* that respectively support the first and second bearings 78*a*, 78*b*. The base portion 61 supports the roller support unit 70, and the roller support unit 70 supports the transport drive roller 31 that transports the medium M, from a lower position in the Z-axis direction. The bearing unit 78 provided in the roller support unit 70 contributes to minimizing the wear of the roller support unit 70 and the transport drive roller 31.

The roller support unit 70 includes the first fulcrum portion 71 configured to pivot about the axis oriented in the Z-axis direction, and therefore the first and second bearings 78*a*, 78*b* are made to pivot about the first fulcrum portion 71 and about the axis oriented in the Z-axis direction by being located in contact with the transport drive roller 31, so as to correct the inclination of the roller support unit 70 with respect to the transport drive roller 31. Such a configuration minimizes local wear of the transport drive roller 31 and the first and second bearings 78*a*, 78*b*, thereby improving the durability of the transport drive roller 31 and the first and second bearings 78*a*, 78*b*.

In addition, the roller support unit 70 is configured to be passively made to pivot upon the first fulcrum portion 71 by the weight of the transport drive roller 31. Therefore, the user can be exempted from the trouble related to the adjustment of the roller support unit 70.

Since the roller support unit 70 also includes the second fulcrum portion 72 configured to pivot about the axis oriented in the Y-axis direction, and therefore the first and second bearings 78*a*, 78*b* are made to pivot about the second fulcrum portion 72 and about the axis oriented in the Y-axis direction by being located in contact with the transport drive roller 31, so as to correct the inclination of the roller support unit 70 with respect to the transport drive roller 31. Such a configuration minimizes local wear of the transport drive roller 31 and the first and second bearings 78*a*, 78*b*, thereby improving the durability of the transport drive roller 31 and the first and second bearings 78*a*, 78*b*.

In addition, the roller support unit 70 is configured to be passively made to pivot upon the second fulcrum portion 72 by the weight of the transport drive roller 31. Therefore, the user can be exempted from the trouble related to the adjustment of the roller support unit 70.

Since the first fulcrum portion 71 is formed in a spherical shape, the roller support unit 70 can smoothly pivot upon the first fulcrum portion 71 about the axis oriented in the Z-axis direction.

Since the second fulcrum portion 72 is formed in an arcuate shape, the roller support unit 70 can smoothly pivot upon the second fulcrum portion 72 about the axis oriented in the Y-axis direction.

The bearing unit 78 (first and second bearings 78*a*, 78*b*) is inserted in the bearing retainer unit 77 (first and second bearing retainers 77*a*, 77*b*) in the insertion direction (first and second insertion directions) coinciding with the direction in which the bearing unit 78 is subjected to the force from the transport drive roller 31. In addition, the first bearing 78*a* is inserted along the first insertion direction to be supported by the first bearing retainer 77*a*, while the second bearing 78*b* is inserted along the second insertion direction different from the first insertion direction, to be supported by the second bearing retainer 77*b*. Therefore, the transport drive roller 31 can be stably supported.

The first bearing 78*a* and the second bearing 78*b* are deviated from each other in the Z-axis direction according to the tension applied to the transport drive roller 31 in the Y-axis direction. Accordingly, the load composed of the self-weight of the transport drive roller 31 and the tension applied thereto can be evenly distributed to the first and second bearings 78*a*, 78*b*. Therefore, the roller support unit 70 can stably support the transport drive roller 31.

Variation

Figure 12:
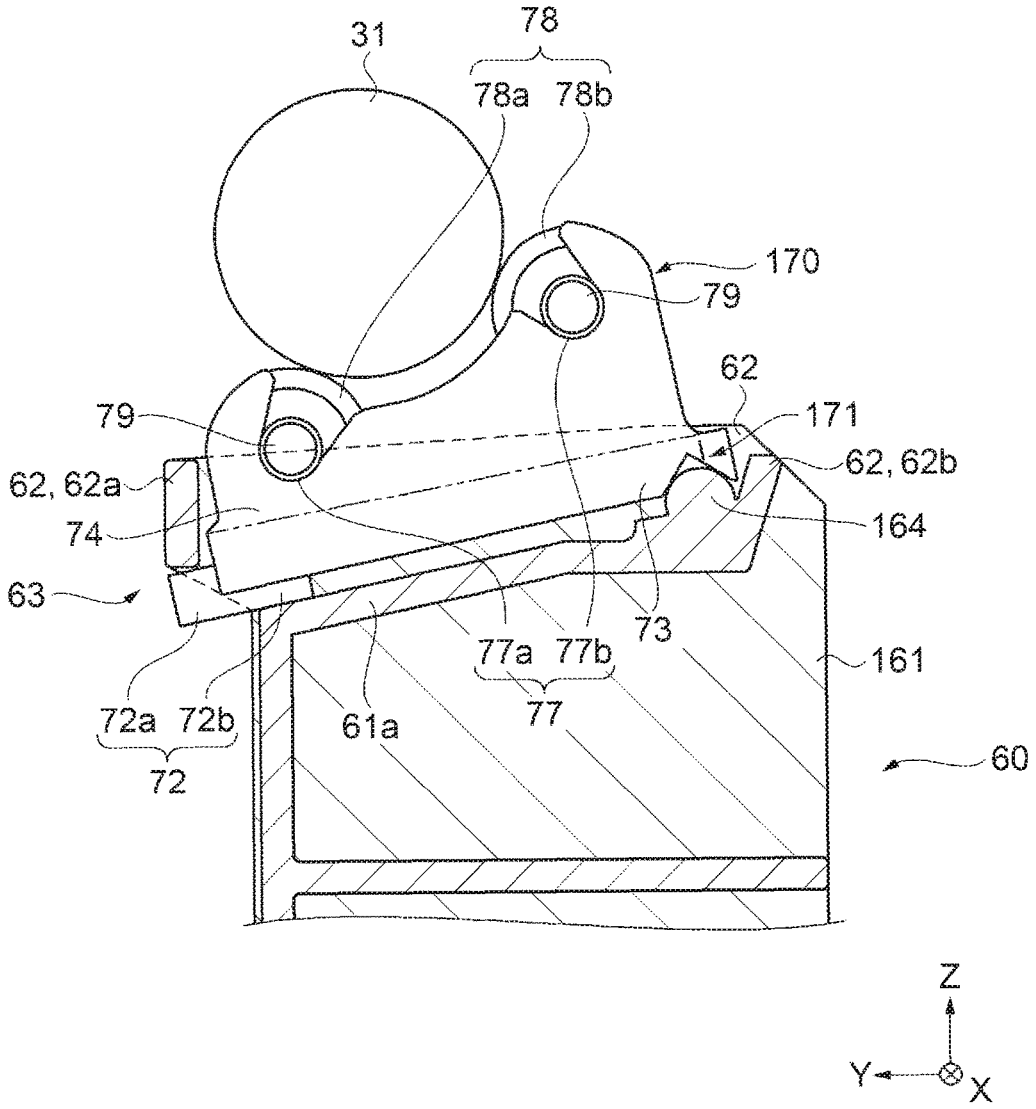
FIG. 12 is a side view showing a roller support assembly according to a variation of the embodiment.

FIG. 12 is a side view showing a roller support assembly according to a variation of the embodiment. Although the first fulcrum portion 71 is provided on the roller support unit 70 as shown in FIG. 3 in the foregoing embodiment, different configurations may be adopted.

Hereunder, the printing apparatus 10 according to the variation will be described. The same elements as those of the embodiment will be given the same numeral, and the description thereof will not be repeated.

As shown in FIG. 12, the roller support assembly 60 includes a first fulcrum portion 164 via which the roller support unit 170 and the base portion 161 are made to contact each other. In this variation, the first fulcrum portion 164 is provided on the base portion 161. The first fulcrum portion 164 is formed on the bisector equally dividing the shorter side of the upper face 61*a* of the base portion 161, so as to protrude upward (+Z-axis side) from a region of the upper face 61*a* on the upstream side (−Y-axis side) in the transport direction F, and inside the outer wall 62*b*. The region of the first fulcrum portion 164 to contact the roller support unit 170 is formed in a spherical shape. More specifically, the first fulcrum portion 164 is formed so as to protrude in a hemispherical shape from the upper face 61*a* of the base portion 161.

The roller support unit 170 includes a groove 171 having a V-shaped cross-section in a view in the width direction (X-axis direction) of the medium M, the groove 171 being formed on the lower surface (surface on the −Z-axis side) of the base plate 73 along the shorter side thereof on the −Y-axis side (upstream side). When the first fulcrum portion 164 of the hemispherical shape and the groove 171 having the V-shaped cross-section are made to contact each other, so that the first bearing 78*a* and the second bearing 78*b* of the roller support unit 170 are made to contact the transport drive roller 31, the roller support unit 170 can pivot upon the first fulcrum portion 164 about an axis oriented in the Z-axis direction. Therefore, the respective axial directions of the first and second bearings 78*a*, 78*b* are corrected so as to become parallel to the axial direction of the transport drive roller 31, and thus the local wear of the transport drive roller 31 and the first and second bearings 78*a*, 78*b* can be minimized.

This application claims priority under 35 U.S.C. § 119 to Japanese Patent Application No. 2015-232817, filed Nov. 30, 2015. The entire disclosure of Japanese Patent Application No. 2015-232817 is hereby incorporated herein by reference.

What is claimed is:

1. A printing apparatus comprising:

a transport roller that transports a medium;

a roller support unit that supports the transport roller on one side in a first direction;

a base member that supports the roller support unit on the one side in the first direction; and a first fulcrum portion via which the roller support unit and the base member are made to contact each other, wherein the roller support unit is configured so as to pivot upon the first fulcrum portion about an axis oriented in the first direction.

2. The printing apparatus according to claim 1, wherein the first fulcrum portion is provided on the roller support unit, and a region of the first fulcrum portion to contact the base member is formed in a spherical shape.

3. The printing apparatus according to claim 1, wherein the first fulcrum portion is provided on the base member, and a region of the first fulcrum portion to contact the roller support unit is formed in a spherical shape.

4. The printing apparatus according to claim 1, wherein the roller support unit includes a second fulcrum portion that contacts the base member at a different position from the first fulcrum portion, so as to pivot upon the second fulcrum portion about an axis oriented in a second direction intersecting the first direction.

5. The printing apparatus according to claim 4, wherein the second fulcrum portion is formed such that a cross-section of a region to contact the base member has an arcuate shape when viewed in the second direction.

6. The printing apparatus according to claim 1, wherein the roller support unit includes a rotatable bearing unit and a bearing retainer unit that supports the bearing unit, and the transport roller is supported by the bearing unit.

7. The printing apparatus according to claim 6, wherein the bearing unit includes a first bearing and a second bearing that support the transport roller at different positions, and the roller support unit is caused to pivot when the first bearing and the second bearing are made to contact the transport roller.

8. The printing apparatus according to claim 6, wherein the bearing unit is inserted in an insertion direction coinciding with a direction in which the bearing unit is subjected to force from the transport roller, so as to be supported by the bearing retainer unit.

9. The printing apparatus according to claim 6, wherein the bearing unit includes a first bearing and a second bearing that support the transport roller at different positions, the bearing retainer unit includes a first bearing retainer and a second bearing retainer in which the bearings are respectively inserted, and the first bearing is inserted in a first insertion direction to be supported by the first bearing retainer, and the second bearing is inserted in a second insertion direction different from the first insertion direction, to be supported by the second bearing retainer.

10. The printing apparatus according to claim 6, wherein the bearing unit includes a first bearing and a second bearing that support the transport roller at different positions, and the first bearing and the second bearing are deviated from each other in the first direction.

* * * * *